US006883451B2

(12) United States Patent
Takada et al.

(10) Patent No.: US 6,883,451 B2
(45) Date of Patent: Apr. 26, 2005

(54) OUTBOARD MOTOR STEERING SYSTEM

(75) Inventors: Hideaki Takada, Wako (JP); Taiichi Otobe, Wako (JP); Hiroshi Mizuguchi, Wako (JP); Yoshinori Masubuchi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 11 days.

(21) Appl. No.: 10/755,331

(22) Filed: Jan. 13, 2004

(65) Prior Publication Data

US 2004/0139902 A1 Jul. 22, 2004

(30) Foreign Application Priority Data

Jan. 17, 2003 (JP) ..... 2003-010049
Jan. 17, 2003 (JP) ..... 2003-010050

(51) Int. Cl.[7] ..... B63H 25/00
(52) U.S. Cl. ..... 114/144 R; 440/51
(58) Field of Search ..... 114/144 R; 440/51

(56) References Cited

U.S. PATENT DOCUMENTS 4,362,515 A * 12/1982 Ginnow ..... 114/144 R
4,416,636 A * 11/1983 Boda ..... 440/51
4,482,331 A * 11/1984 Boda ..... 440/51

FOREIGN PATENT DOCUMENTS

JP 62-125996 6/1987
JP 02-279495 11/1990

* cited by examiner

*Primary Examiner*—Lars A. Olson
(74) *Attorney, Agent, or Firm*—Westerman, Hattori, Daniels & Adrian, LLP

(57) ABSTRACT

An outboard motor steering system for an outboard motor mounted on a stern of a boat and having an internal combustion engine at its upper portion and a propeller with a rudder at its lower portion powered by the engine to propel and steer the boat. The system includes a swivel shaft connected to the propeller to turn it relative to the boat, a swivel case fixed to the outboard motor and rotatably accommodating the swivel shaft, and a hydraulic actuator connected to the swivel shaft to rotate it. The actuator has a shape whose height is larger than its width and is installed in such a manner that a direction of the height is in parallel with a vertical direction, so as not to project outside a profile of the outboard motor, obtained by looking down the outboard motor from downward, regardless of a steered angle of the outboard motor. Specifically, the actuator is two hydraulic cylinders installed in an over-under manner or an elliptic hydraulic cylinder having a plurality of piston rods installed in the same manner. With this, it can enhance the output of the actuator to increase the steering force (torque), can prevent the actuator from projecting outside the profile, and can avoid constriction of the space around the outboard motor.

12 Claims, 11 Drawing Sheets

OUTBOARD MOTOR STEERING SYSTEM

BACKGROUND OF THE INVENTION

1. Field of the Invention

This invention relates to an outboard motor steering system.

2. Description of the Related Art

Almost all outboard motor steering systems have up to now been of types operated by human power, such as the tiller handle type used to turn the rudder by manually operating the tiller handle attached to the outboard motor and the remote control type used to remotely operate a steering mechanism through a push-pull cable in response to rotation of a steering wheel manipulated by the operator.

Since human-powered steering systems are disadvantageous because they tend to have an unpleasant steering "feel" owing to, for instance, heavy steering load, as taught in Japanese Laid-Open Patent Application Sho 62 (1987)-125996, an add-on mechanism constituted as a separate unit from the outboard motor and used to power-assist the turning of the tiller handle is known. This mechanism typically includes a steering actuator such as a hydraulic cylinder attached to the front (boat side) of an outboard motor through a link mechanism connected between the actuator and the tiller handle. The add-on steering system using such an actuator also has disadvantages, most notably that its structure is complicated, that it adds to the number and weight of the components, and that it takes up space between the front of the outboard motor and the rear of the boat.

Attempts have been made to overcome these drawbacks. Japanese Laid-Open Patent Application No. Hei 2(1990)-279495 ('495), for example, teaches a steering system including a steering actuator that is not attached to the boat, but is directly attached to the outboard motor, thereby minimizing increase in the number and weight of the constituent components and saving space.

However, the steering system taught by '495 is disadvantageous from the aspect of saving space around the outboard motor because in some operating states of the actuator, the actuator projects from the outboard motor in the horizontal direction. As a result, when two outboard motors are installed side by side in a dual motor configuration, the installation space must be enlarged by the amount of projection of the actuator so as to prevent interference between the outboard motors. This problem is more serious when the actuator is enlarged so as to increase the steering force (torque), since this requires the actuator to project farther in the horizontal direction.

SUMMARY OF THE INVENTION

An object of the present invention is therefore to overcome the foregoing issues by providing an outboard motor steering system having a steering actuator that power-assists the steering in which the output of the steering actuator is enhanced to increase steering force, whilst the steering actuator is installed inside the outboard motor within a profile (vertical projection plane) of the outboard motor regardless of the steered angle, so as not to cause a problem of space utilization.

In order to achieve the foregoing objects, this invention provides a steering system for an outboard motor mounted on a stern of a boat and having an internal combustion engine at its upper portion and a propeller with a rudder at its lower portion powered by the engine to propel and steer the boat, comprising: a swivel shaft connected to the propeller to turn the propeller relative to the boat; a swivel case fixed to the outboard motor and rotatably accommodating the swivel shaft; and a hydraulic actuator connected to the swivel shaft to rotate the swivel shaft, the hydraulic actuator having a shape whose height is larger than its width and being installed in such a manner that a direction of the height is in parallel with a vertical direction, such that the actuator does not project outside a profile of the outboard motor, obtained by looking down the outboard motor from downward in the vertical direction, regardless of a steered angle of the outboard motor.

BRIEF DESCRIPTION OF THE DRAWINGS

The above and other objects and advantages of the invention will be more apparent from the following description and drawings, in which.

DETAILED DESCRIPTION OF THE PREFERRED EMBODIMENTS

An outboard motor steering system according to a first embodiment of the present invention will now be explained with reference to the attached drawings.

Figure 1:
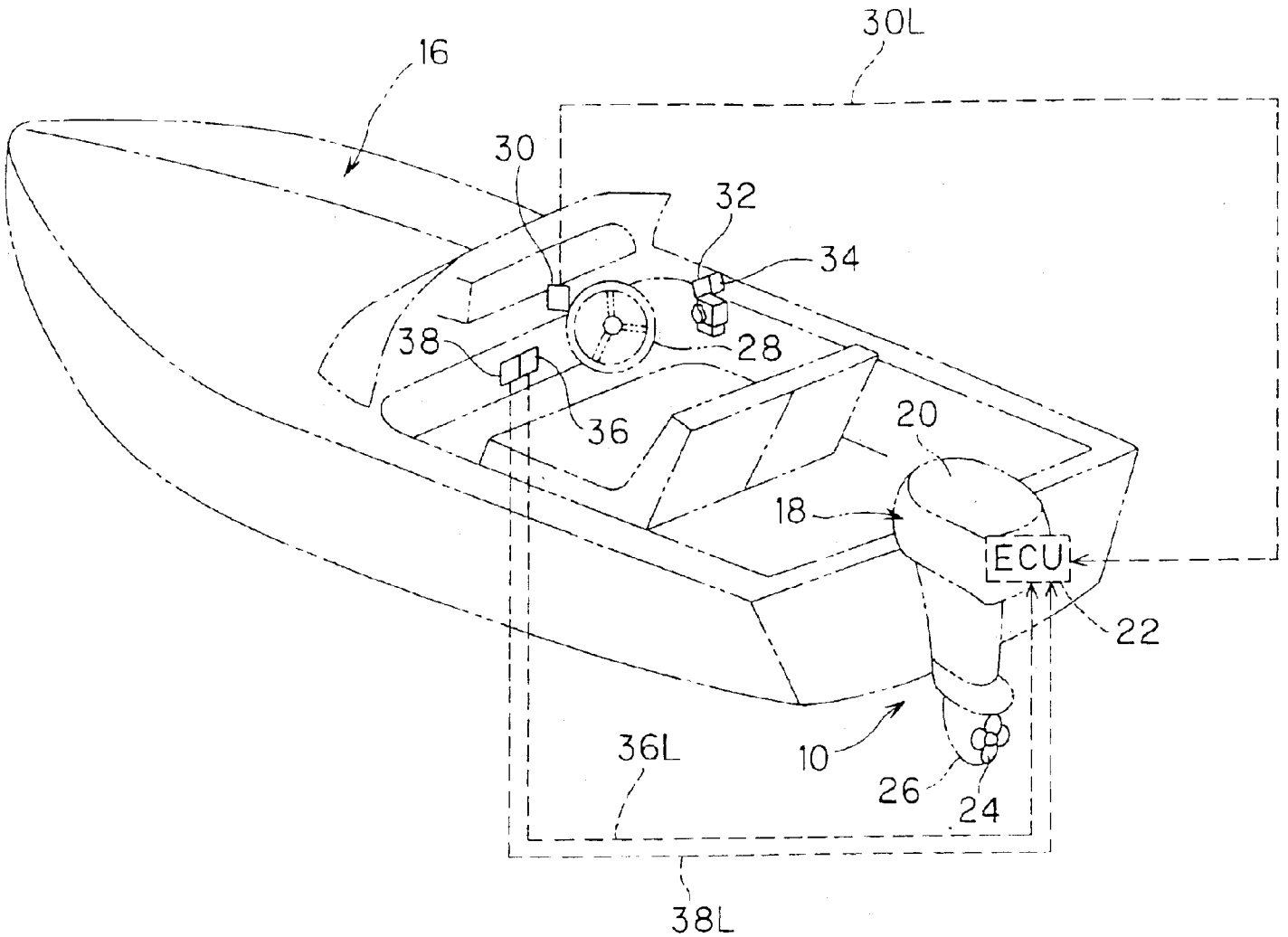
FIG. 1 is an overall schematic view of an outboard motor steering system according to a first embodiment of the invention.
Figure 2:
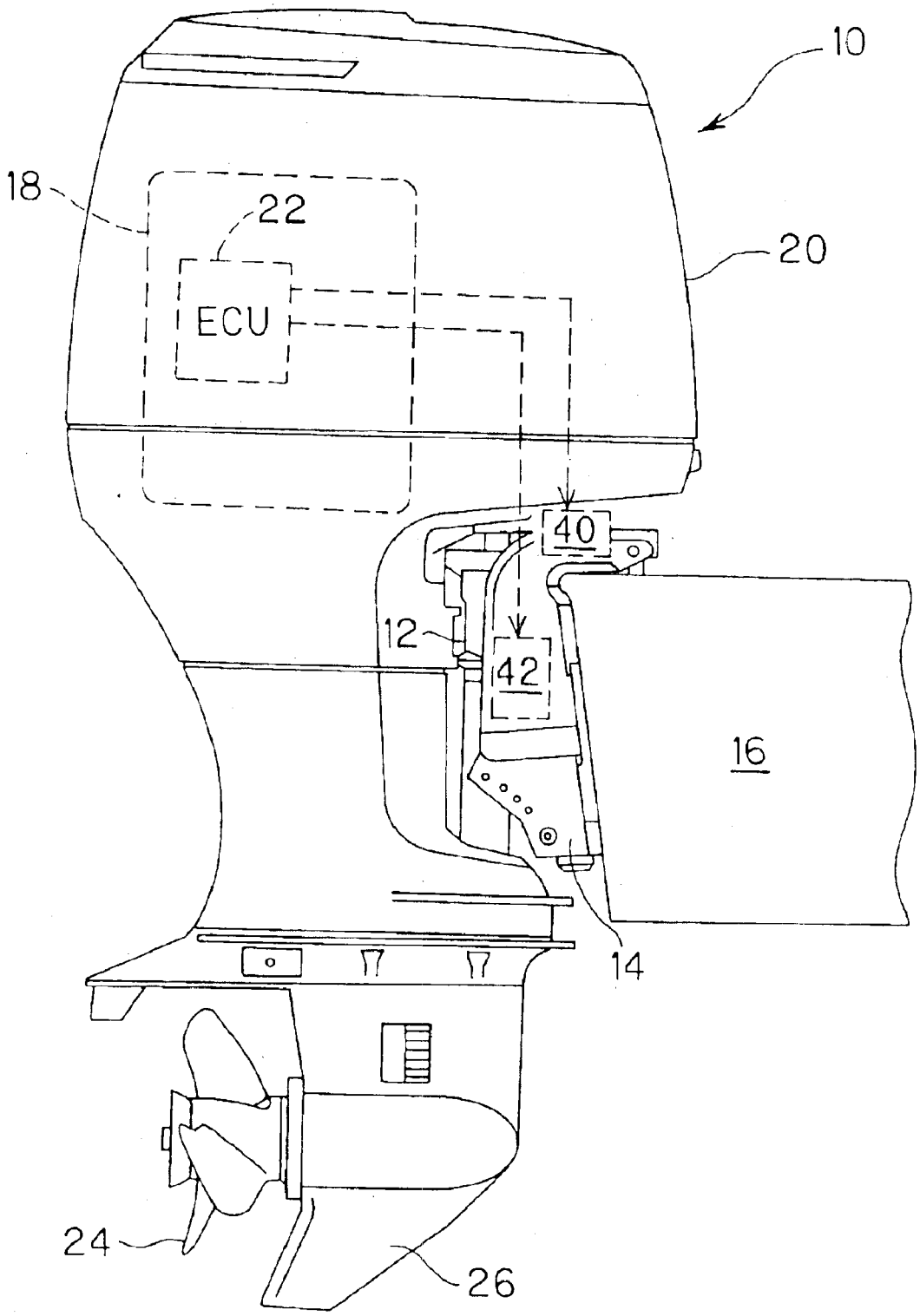
FIG. 2 is an explanatory side view of a part including an outboard motor of FIG. 1.

FIG. 1 is an overall schematic view of the outboard motor steering system, and FIG. 2 is an explanatory side view of a part including an outboard motor of FIG. 1.

Reference numeral 10 in FIGS. 1 and 2 designates an outboard motor built integrally of an internal combustion engine, propeller shaft, propeller and other components. As illustrated in FIG. 2, the outboard motor 10 is mounted on the stern of a boat (hull) 16 via a swivel case 12 (that rotatably accommodates or houses a swivel shaft (not shown)) and stern bracket 14 (to which the swivel case 12 is connected), to be rotatable about the vertical and horizontal axes.

As shown in FIG. 2, the outboard motor 10 is equipped with an internal combustion engine 18 at its upper portion. The engine 18 is a spark-ignition, in-line four-cylinder gasoline engine with a displacement of 2,200 cc. The engine 18, located inside the outboard motor 10, is enclosed by an engine cover 20 and positioned above the water surface. An electronic control unit (ECU) 22 constituted of a microcomputer is installed near the engine 18 enclosed by the engine cover 20.

The outboard motor 10 is equipped at its lower part with a propeller 24 and a rudder 26 adjacent thereto. The rudder 26 is fixed near the propeller 24 and does not rotate independently. The propeller 24, which operates to propel the boat 16 in the forward and reverse directions, is powered by the engine 18 through a crankshaft, drive shaft, gear mechanism and shift mechanism (none of which is shown).

As shown in FIG. 1, a steering wheel 28 is installed near the operator's seat of the boat 16. A steering angle sensor 30 is installed near the steering wheel 28. The steering angle sensor 30 is made of a rotary encoder and outputs a signal in response to the turning of the steering wheel 28 inputted by the operator. A throttle lever 32 and a shift lever 34 are mounted on the right side of the operator's seat. Operations inputted to these are transmitted to a throttle valve and the shift mechanism (neither shown) of the engine 18 through push-pull cables (not shown).

A power tilt switch 36 for regulating the tilt angle and a power trim switch 38 for regulating the trim angle of the outboard motor 10 are also installed near the operator's seat. These switches output signals in response to tilt-up/down and trim-up/down instructions inputted by the operator. The outputs of the steering angle sensor 30, power tilt switch 36 and power trim switch 38 are sent to the ECU 22 over signal lines 30L, 36L and 38L.

In response to the output of the steering angle sensor 30 sent over the signal line 30L, the ECU 22 operates an hydraulic actuator, more specifically a hydraulic cylinder 40 (shown in FIG. 2) to extend or contract so as to steer the outboard motor 10, i.e., change the direction of the propeller 24 and rudder 26, and thereby turn the boat 16 right or left. In response to the outputs of the power tilt switch 36 and power trim switch 38 sent over the signal lines 36L, 38L, the ECU 22 operates a conventional power tilt-trim unit 42 to regulate the tilt angle and trim angle of the outboard motor 10.

Figure 3:
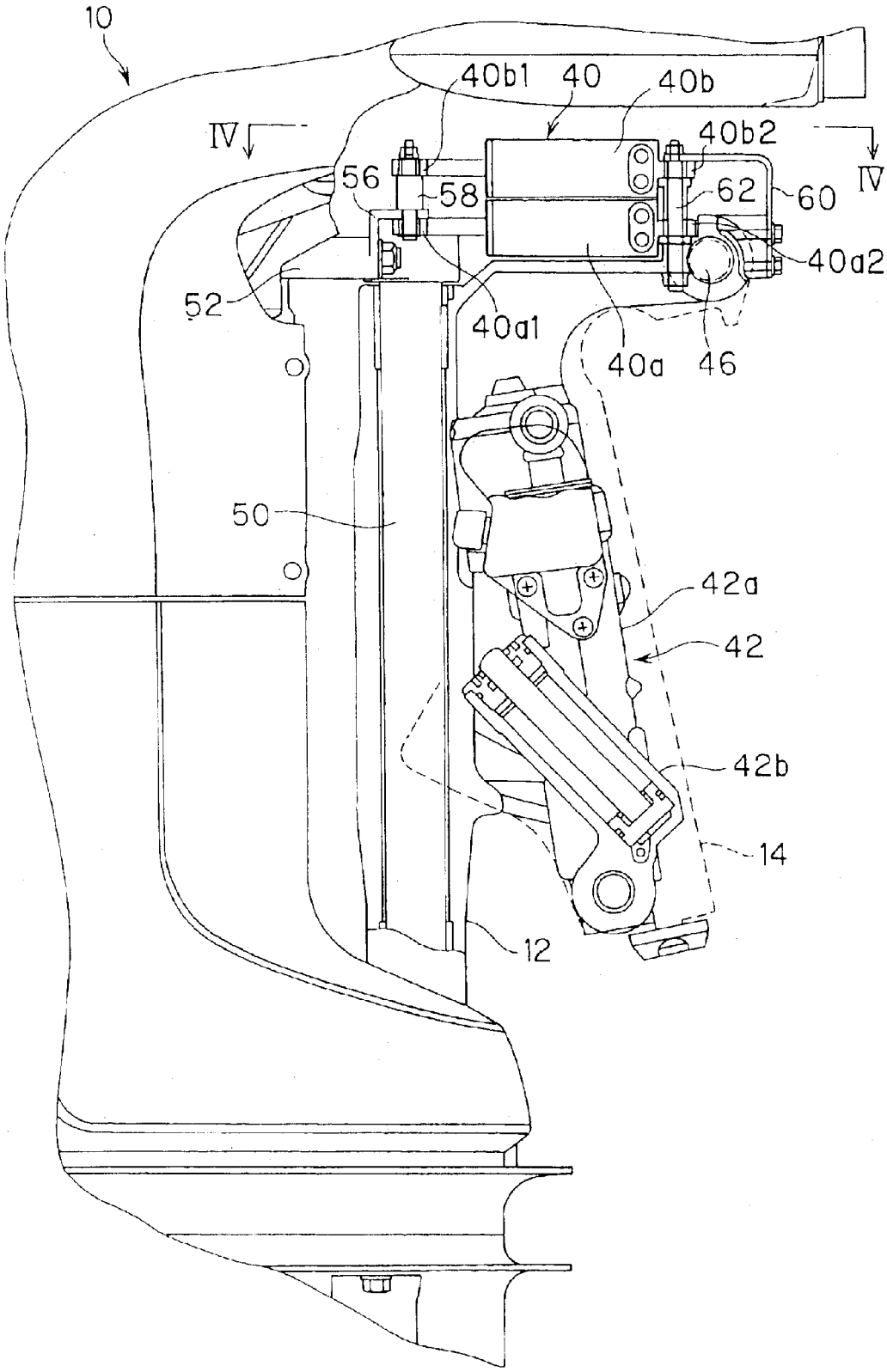
FIG. 3 is an enlarged partial side view of a part of FIG. 2.

FIG. 3 is an enlarged explanatory side view of FIG. 2 and shows the swivel case 12 (or thereabout) of the outboard motor 10.

As illustrated in FIG. 3, the power tilt-trim unit 42 is equipped with one hydraulic cylinder 42*a* for tilt angle regulation and, constituted integrally therewith, two hydraulic cylinders 42*b* for trim angle regulation (only one shown). One end (cylinder bottom) of the tilt hydraulic cylinder 42*a* is fastened to the stem bracket 14 and through it to the boat 16 and the other end (piston rod head) thereof abuts on the swivel case 12. One end (cylinder bottom) of each trim hydraulic cylinder 42*b* is fastened to the stem bracket 14 and through it to the boat 16, similarly to the one end of the tilt hydraulic cylinder 42*a*, and the other end (piston rod head) thereof abuts on the swivel case 12.

The swivel case 12 is connected to the stem bracket 14 through a tilting shaft 46 to be relatively displaceable about the tilting shaft 46. As mentioned above, the swivel shaft (now assigned with reference numeral 50) is rotatably accommodated inside the swivel case 12. The swivel shaft 50 extends in the vertical direction and has its upper end fastened to a mount frame 52 and its lower end fastened to a lower mount center housing (not shown). The mount frame 52 and lower mount center housing are fastened to a frame on which the engine 18 and the propeller 24, etc., are mounted.

Figure 4:
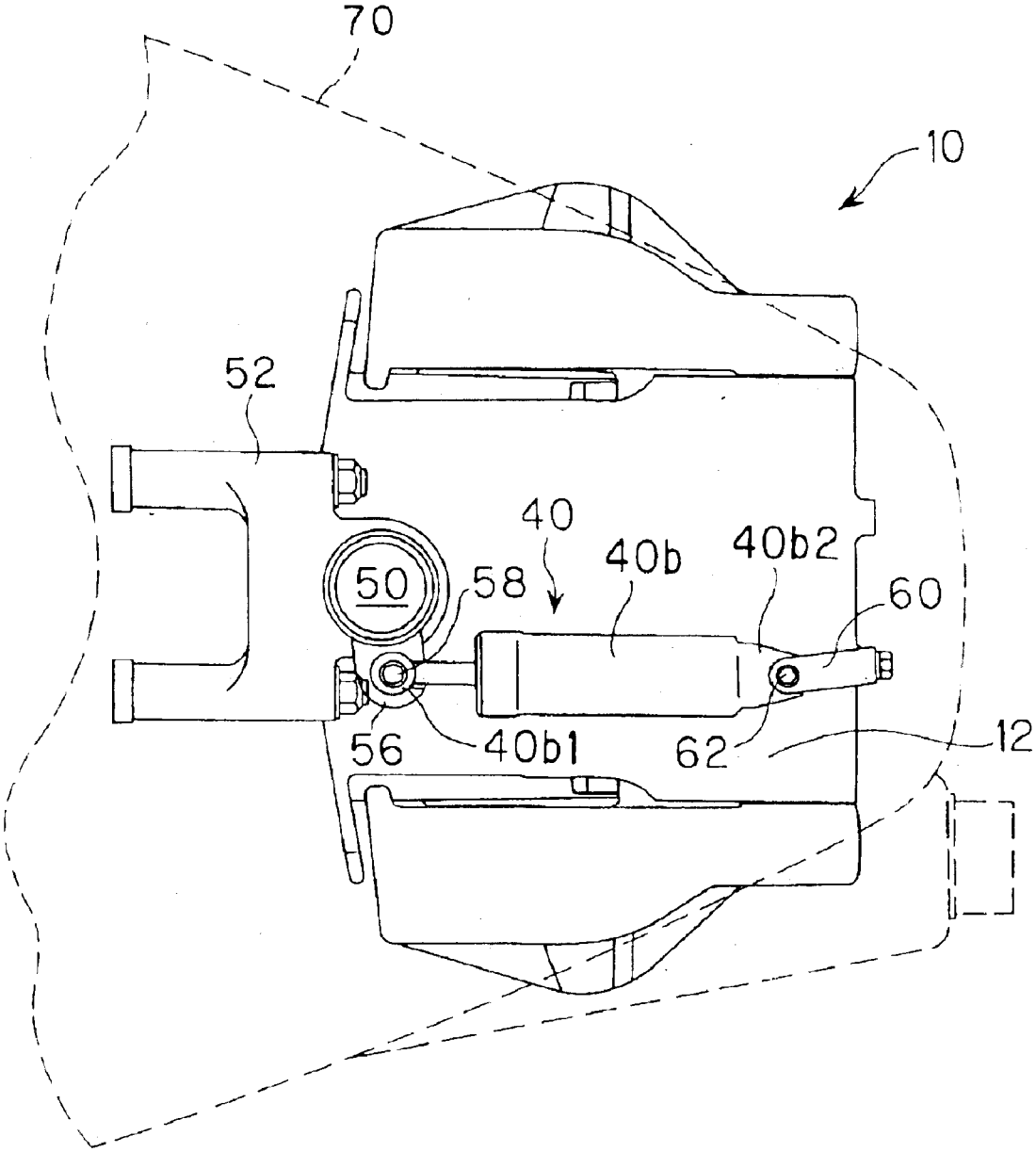
FIG. 4 is a cross-sectional view taken along the line IV—IV of FIG. 3 and is also a view looking down the outboard motor from above (downward in the vertical direction) that illustrates a positional relationship of the steering hydraulic cylinders, etc., relative to a profile (vertical projection plane) of the outboard motor when the outboard motor is steered in a straight-advancing direction.

FIG. 4 is a cross-sectional view taken along the line IV—IV of FIG. 3.

Continuing the explanation with reference to FIGS. 3 and 4, the steering hydraulic cylinder 40 is installed at a position above the swivel case 12. Specifically, the steering hydraulic cylinder 40 is a double-acting hydraulic cylinder comprising a plurality of (two) cylindrical cylinders, i.e., a first cylinder 40*a* and a second cylinder 40*b*. As best shown in FIG. 3, the first and second cylinders 40*a*, 40*b* are installed above the swivel case 12 in an over-under or overlapped manner in the vertical (gravitational) direction such that their longitudinal axes (the cylinder axes) are in parallel with the horizontal direction (that crosses the vertical direction at a right angle). This is because it is easier to find a space in that position above the swivel case 12 in the outboard motor 10 in the sense of the vertical direction. In addition to the first and second hydraulic cylinders 40*a*, 40*b*, a hydraulic circuit (not shown) is installed, near the cylinder 40, at the position above the swivel case 12 for supplying hydraulic pressure to the cylinders 40*a*, 40*b*.

A first stay 56 is provided at the mount frame 52 near the uppermost or thereabout of the swivel shaft 50. The first stay 56 is fixed with a first cylindrical member 58 having a longitudinal axis that is in parallel with the vertical direction. A displaceable end (connecting portion) of the first cylinder 40*a*, i.e., a piston rod head 40*a*1 of the cylinder 40*a* is rotatably fixed to the first cylindrical member 58 at its lower end or thereabout, whilst a displaceable end (connecting portion) of the second cylinder 40*b*, i.e., a piston rod head 40*b*1 of the cylinder 40*b* is rotatably fixed to the first cylindrical member 58 at its upper end or thereabout. Thus, the piston rod heads 40*a*1, 40*b*1 of the first and second cylinders 40*a*, 40*b* are arranged to be coaxial with each other and are fixed to the mount frame 52 through the first stay 56 and the first cylindrical member 58.

Similarly, a second stay 60 is fixed to the swivel case 12 at its upper position and close to the boat. The second stay 60 is fixed with a second cylindrical member 62 similarly having a longitudinal axis that is in parallel with the vertical direction. A fixed end (connecting portion) of the first cylinder 40*a*, i.e., a cylinder bottom 40*a*2 of the cylinder 40*a* is rotatably fixed to the second cylindrical member 62 at its lower end or thereabout, whilst a fixed end (connecting portion) of the second cylinder 40*b*, i.e., a cylinder bottom 40*b*2 of the cylinder 40*b* is rotatably fixed to the second cylindrical member 62 at its upper end or thereabout. Thus, the cylinder bottoms 40*a*2, 40*b*2 of the first and second cylinders 40*a*, 40*b* are also arranged to be coaxial with each other and are fixed to the position above the swivel case 12 through the second stay 60 and the second cylindrical member 62.

When the operator steers the steering wheel 28, the amount of steering is detected by the steering angle sensor 30 and is inputted to the ECU 22. The ECU 22 determines or calculates a current supply command in response to the inputted amount of steering (a command to steer) and outputs the same to a driver circuit of an electric motor (not shown) to drive a hydraulic pump through the hydraulic circuit such that the first and second cylinders 40*a*, 40*b* extend or contract to rotate the swivel shaft 50. Since the first and second cylinders 40*a*, 40*b* are arranged such that they are overlapped in the over-under manner in the vertical direction and the longitudinal axes are in parallel with the horizontal axis, and in addition, since the piston rod heads 40*a*1, 40*b*1 and their cylinder bottoms 40*a*2, 40*b*2 of the cylinders 40*a*, 40*b* are respectively arranged to be coaxial with each other, their driven amounts (the amounts of extension and contraction) become equal when supplied with hydraulic pressure in response to the command to steer.

Figure 5:
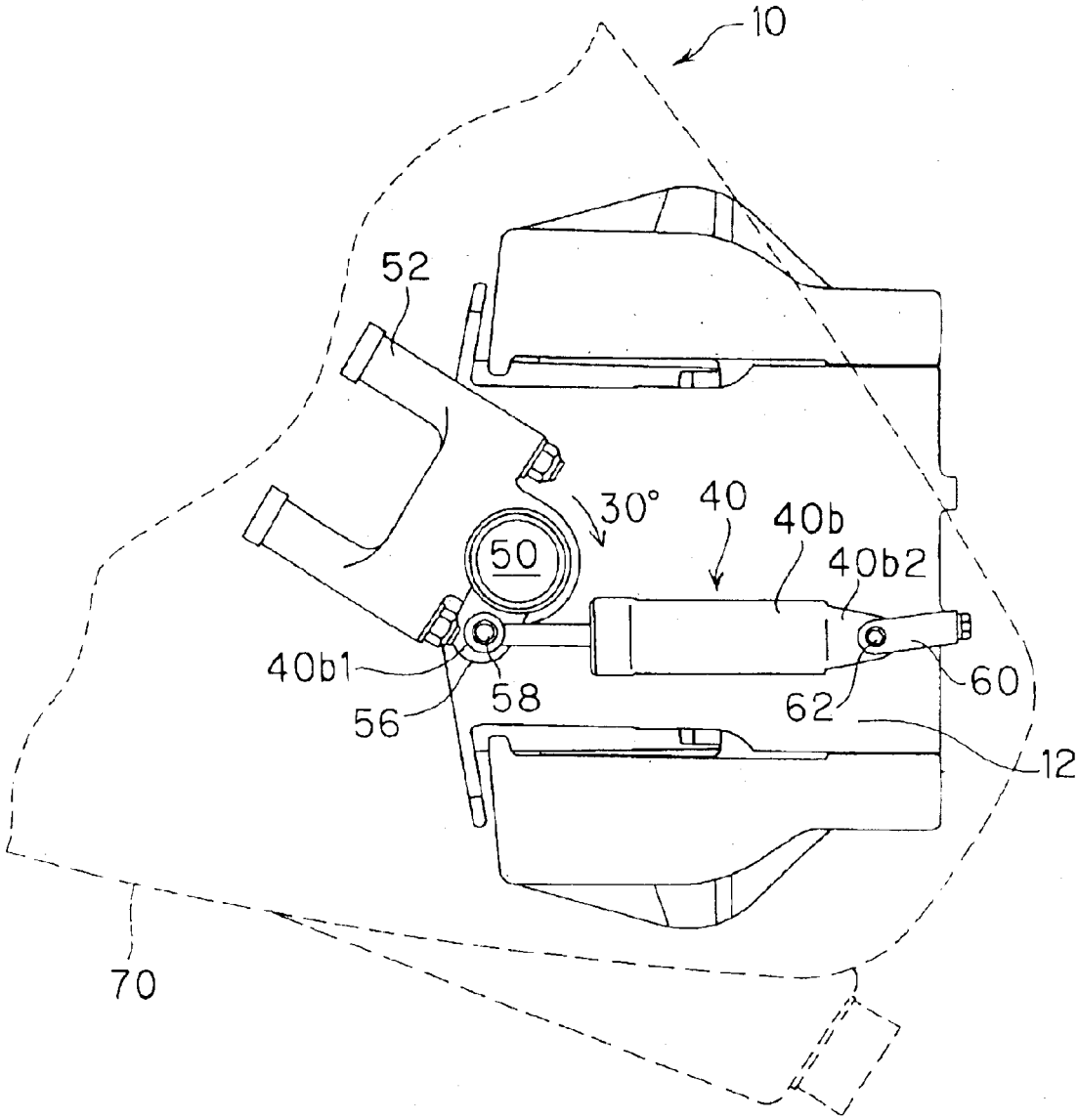
FIG. 5 is a view, similar to FIG. 4, but showing the positional relationship when the outboard motor is steered (rotated) right at its maximum.

Thus, by operating the first and second cylinders 40*a*, 40*b* to extend or contract, the steering of the outboard motor 10 in the horizontal direction about the swivel shaft 50 is power-assisted and the propeller 24 (and the rudder 26) is swung to steer the boat 16. Specifically, the swivel shaft 50 and mount frame 52 are rotated right (viewed from the above) relative to the boat 16 when the cylinders 40*a*, 40*b* are driven to extend, and the outboard motor 10 is steered right such that the boat 16 is steered left (viewed from the above) as shown in FIG. 5. On the contrary, when the cylinders 40*a*, 40*b* are driven to contract, the swivel shaft 50 and mount frame 52 rotate left to steer the outboard 10 left such that the boat 16 is steered right as shown in FIG. 6.

Figure 6:
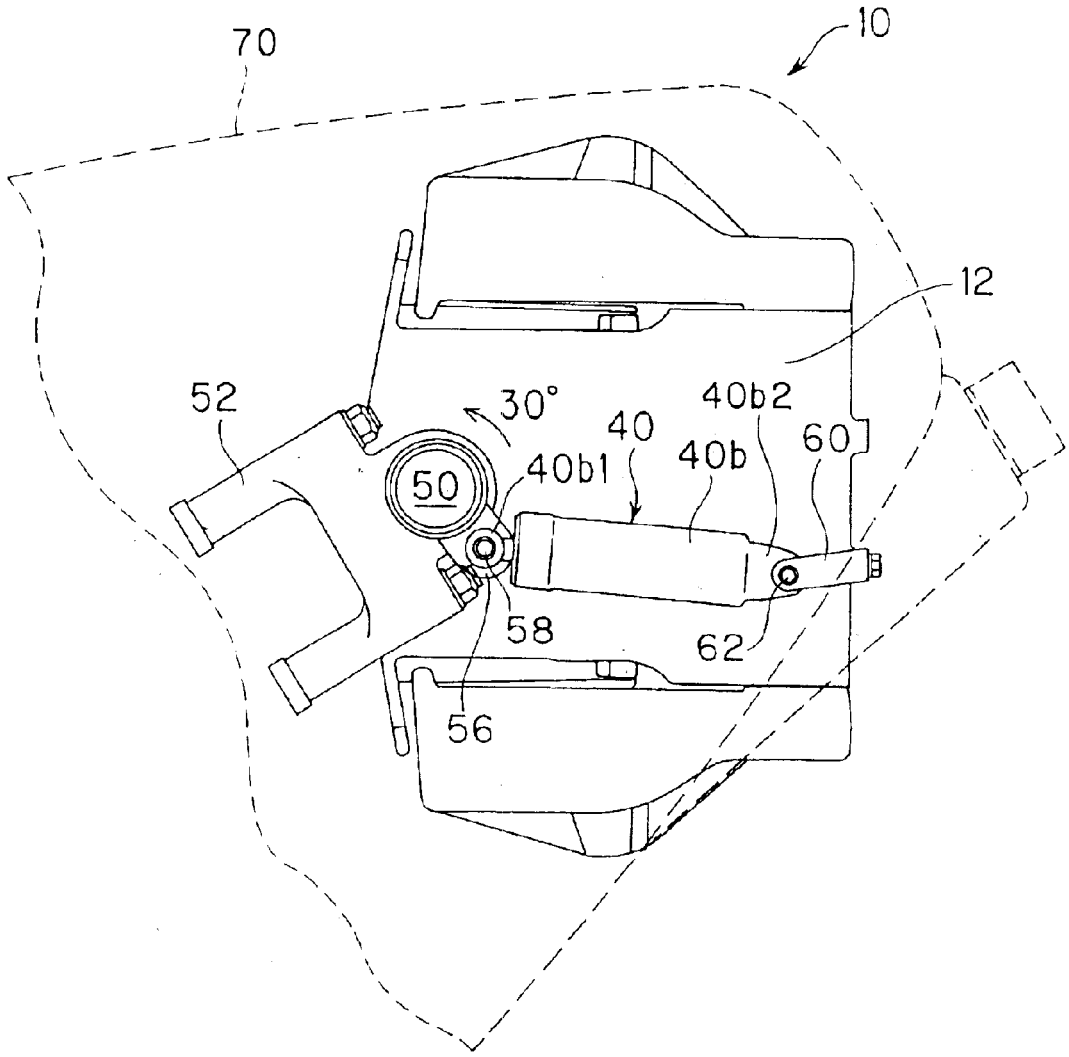
FIG. 6 is a view, similar to FIG. 4, but showing the positional relationship when the outboard motor 10 is steered (rotated) left at its maximum.

FIGS. 4 to 6 are explanatory views looking down the outboard motor 10 from above (downward in the vertical direction), in which reference numeral 70 designates a profile (the vertical projection plane) of the outboard motor 10 in the plan views. Specifically, FIG. 4 is the cross-sectional view taken along the line IV—IV of FIG. 3 as mentioned above and is also a view looking down the outboard motor from above (downward in the vertical direction) that illustrates the positional relationship of the steering hydraulic cylinders 40, etc., relative to the profile 70 when the outboard motor 10 is steered in a straight-advancing direction. FIG. 5 illustrates that when the outboard motor 10 is steered (rotated) right at its maximum, whereas FIG. 6 illustrates that when the outboard motor 10 is steered (rotated) left at its maximum. As shown in FIGS. 5 and 6, the overall steerable angle (rudder turning angle) of the outboard motor 10 is 60 degrees, 30 degrees to the right and 30 degrees to the left.

As mentioned above, the hydraulic actuator 40 is thus arranged to have a shape whose height is larger than its width and being installed in such a manner that a direction of the height is in parallel with a vertical direction, such that the actuator does not project outside the profile 70 of the outboard motor 10, obtained by looking down the outboard motor from downward in the vertical direction, regardless of a steered angle of the outboard motor 10. Specifically, the actuator comprises a plurality of (two) hydraulic cylinders 40*a*, 40*b*, whose displaceable ends (40*a*1, 40*b*1) are connected to the mount frame 52, whereas whose fixed ends (40*a*2, 40*b*2) are connected to the swivel case 12, and the cylinders 40*a*, 40*b* are installed in an over-under manner such that the direction of the height is in parallel with the vertical direction.

Having been configured in the foregoing manner, the outboard motor steering system according to this embodiment is arranged such that the swivel shaft 50 (acting as the steering shaft of the motor 10) is rotated by a plurality of actuators, i.e., two steering hydraulic cylinders 40 (comprised of the first and second cylinders 40*a*, 40*b*) to steer the motor 10. This can enhance the output of the actuator and hence, can increase the steering force (torque).

Further, since the first and second cylinders 40*a*, 40*b* are arranged such that they are overlapped in the over-under manner in the vertical direction and their longitudinal axes are in parallel with the horizontal direction, as understood from FIGS. 4 to 6, the cylinders 40*a*, 40*b* never project horizontally outside the profile 70 of the outboard motor 10, even when the motor 10 is steered at its maximum. In other words, the steering force is improved, not by increasing the size of the cylinder itself, but by increasing the number of cylinders to two and by arranging them in an over-and-under manner in the vertical direction at the position above the swivel case 12 such that the two cylinders 40*a*, 40*b* remain inside the profile 70 regardless of the steered angle of the motor 10. With this, any of the two cylinders 40*a*, 40*b* does not project outside the profile 70. Since the portion above the swivel case 12 is relatively free to install the cylinders 40*a*, 40*b*, constriction of the space around the outboard motor 10 can therefore be avoided.

Further, the displaceable ends of the first and second cylinders 40*a*, 40*b*, i.e., the piston rod heads 40*a*1, 40*b*1 of the cylinders are connected to the mount frame 52 (that is fixed to the swivel shaft 50), whilst the fixed ends of the cylinders 40*a*, 40*b*, i.e., the cylinder bottoms 40*a*2, 40*b*2 of the cylinders are connected to the swivel case 12. More generally, the displaceable ends of the cylinders 40*a*, 40*b* are connected to the portion that is displaceable relative to the boat 16 when the outboard motor 10 is steered, whereas the fixed ends thereof are connected to the portion that is not displaceable when the outboard motor 10 is steered. Thus, since the system is arranged such that the outputs or displacements of the first and second hydraulic cylinders 40*a*, 40*b* are directly transmitted to the outboard motor 10, without using a link mechanism or some similar factors, this can prevent occurrence of play, improve the steering response, and decrease the space necessary for installing the cylinders 40*a*, 40*b*. In addition, this configuration is simple and can therefore decrease the number of components or works for installing the cylinders 40*a*, 40*b*.

Further, since the piston rod heads 40*a*1, 40*b*1 of the cylinders 40*a*, 40*b* (these are the ones of the positions) that connect the cylinders 40*a*, 40*b* to the outboard motor 10 (these are the others of the similar connecting portions) are respectively arranged to be coaxial with each other, the configuration is made simpler. Therefore, even if more number of cylinders are required to increase the steering force, the number of components or works for installing the cylinders will be decreased.

Furthermore, since the amount of displacements (the amounts of extension/contraction) of the two cylinders 40*a*, 40*b* necessary to rotate the swivel shaft 50 are made equal for the two cylinders 40*a*, 40*b*, this will facilitate a control to supply hydraulic pressure to them.

It should be noted in the first embodiment that, although the number of cylinders is made two, this embodiment should not be limited thereto and the number of cylinders may be increased to three or more.

Figure 7:
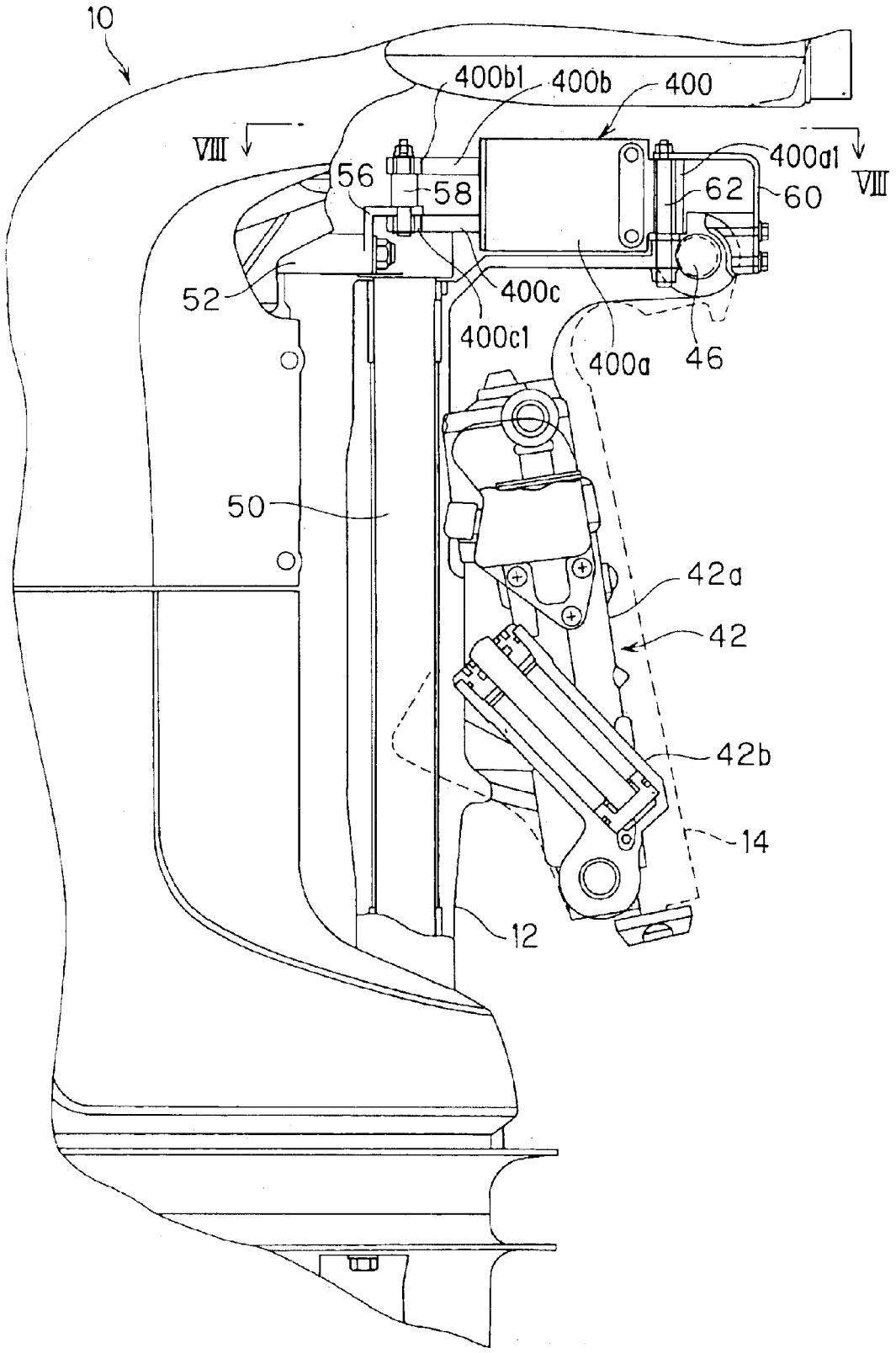
FIG. 7 is a view, similar to FIG. 3, but showing an outboard motor steering system according to a second embodiment of the invention.
Figure 8:
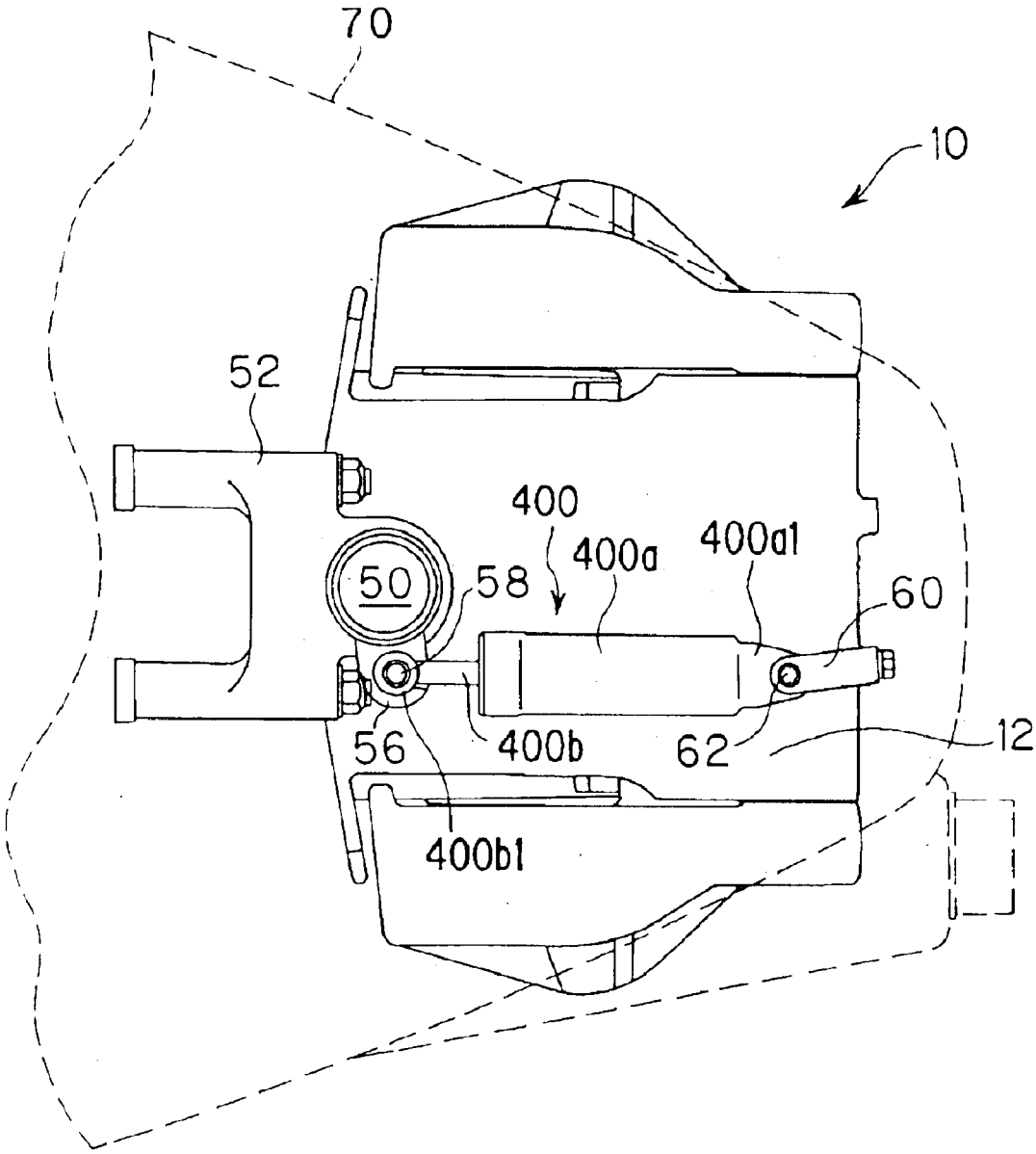
FIG. 8 is a cross-sectional view taken along the line VIII—VIII of FIG. 7.
Figure 9:
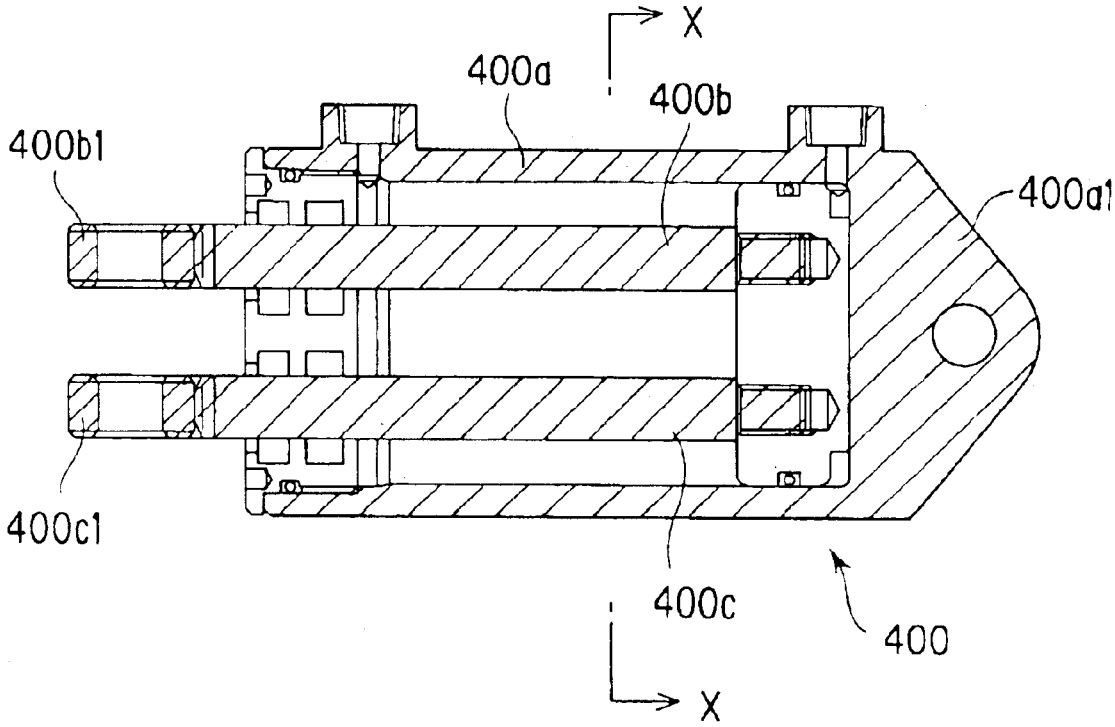
FIG. 9 is an explanatory and enlarged cross-sectional view of the steering hydraulic cylinder used in the system according to the second embodiment.
Figure 10:
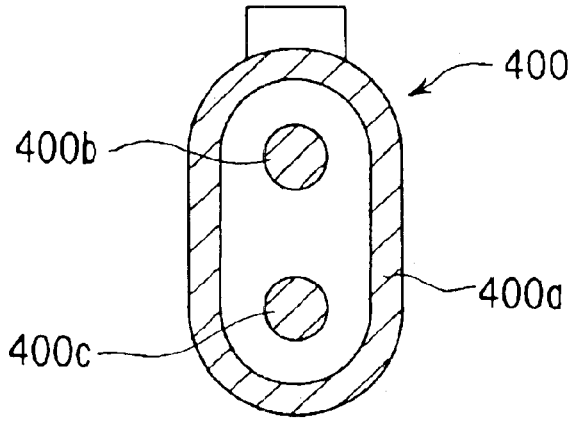
FIG. 10 is a cross-sectional view taken along the line X—X of FIG. 9.

FIG. 7 is a view, similar to FIG. 3, but showing an outboard motor steering system according to a second embodiment of the invention, FIG. 8 is a cross-sectional view taken along the line VIII—VIII of FIG. 7, FIG. 9 is an explanatory and enlarged cross-sectional view of the elliptic cylinder 400, and FIG. 10 is a cross-sectional view taken along the line X—X of FIG. 9.

Explaining this with emphasis on differences from the first embodiment, in the system according to the second embodiment, as shown in the figures, instead of the cylindrical hydraulic cylinders 40 used in the first embodiment, a hydraulic double-acting cylinder of elliptic shape in cross section (hereinafter referred to as "elliptic cylinder" and assigned with new reference numeral 400) is used as the actuator. The elliptic cylinder 400 has a cylinder 400*a* that is similarly formed in the elliptic shape in cross-section. As shown in FIGS. 9 and 10, the elliptic cylinder 400 (400*a*) accommodates a plurality of (two) piston rods (displaceable sides) comprising a first piston rod 400*b* and a second piston rod 400*c*, in the direction of the major axis. The elliptic cylinder 400 is installed at the position above the swivel case 12, similarly to the cylinder 40 in the first embodiment, as best shown in FIGS. 7 and 8, in such a manner that the direction of major axis is in parallel with the vertical direction. More specifically, the elliptic cylinder 400 is installed above the swivel case 12 in such a manner that its first and second piston rods 400*b*, 400*c* are in the over-under or overlapped manner in the vertical direction such that their longitudinal axes of piston rods 400*b*, 400*c* are in parallel with the horizontal direction.

More specifically, the displaceable ends (connecting portion) of the first piston rod 400*b*, i.e., a piston rod head 400*b*1 of the first piston rod 400*b* is rotatably fixed to the first cylindrical member 58 at its upper end or thereabout, whilst a displaceable end (connecting portion) of the second piston rod 400*c*, i.e., a piston rod head 400*c*1 of the second piston rod 400*c* is rotatably fixed to the first cylindrical member 58 at its lower end or thereabout. Thus, the piston rod heads 400*b*1, 400*c*1 of the first and second piston rods 400*b*, 400*c* are arranged to be coaxial with each other and fixed to the mount frame 52 through the first stay 56 and the first cylindrical member 58, similarly to the cylinders 40 in the first embodiment.

Further, a fixed end (connecting portion) of the elliptic cylinder 400 (400*a*), i.e., a cylinder bottom 400*a*1 of the cylinder 400 (400*a*) is rotatably fixed to the second cylindrical member 62. Thus, the cylinder bottom 400*a*1 of the elliptic cylinder 400 (400*a*) is fixed to the portion above the swivel case 12 through the second stay 60 and the second cylindrical member 62.

Figure 11:
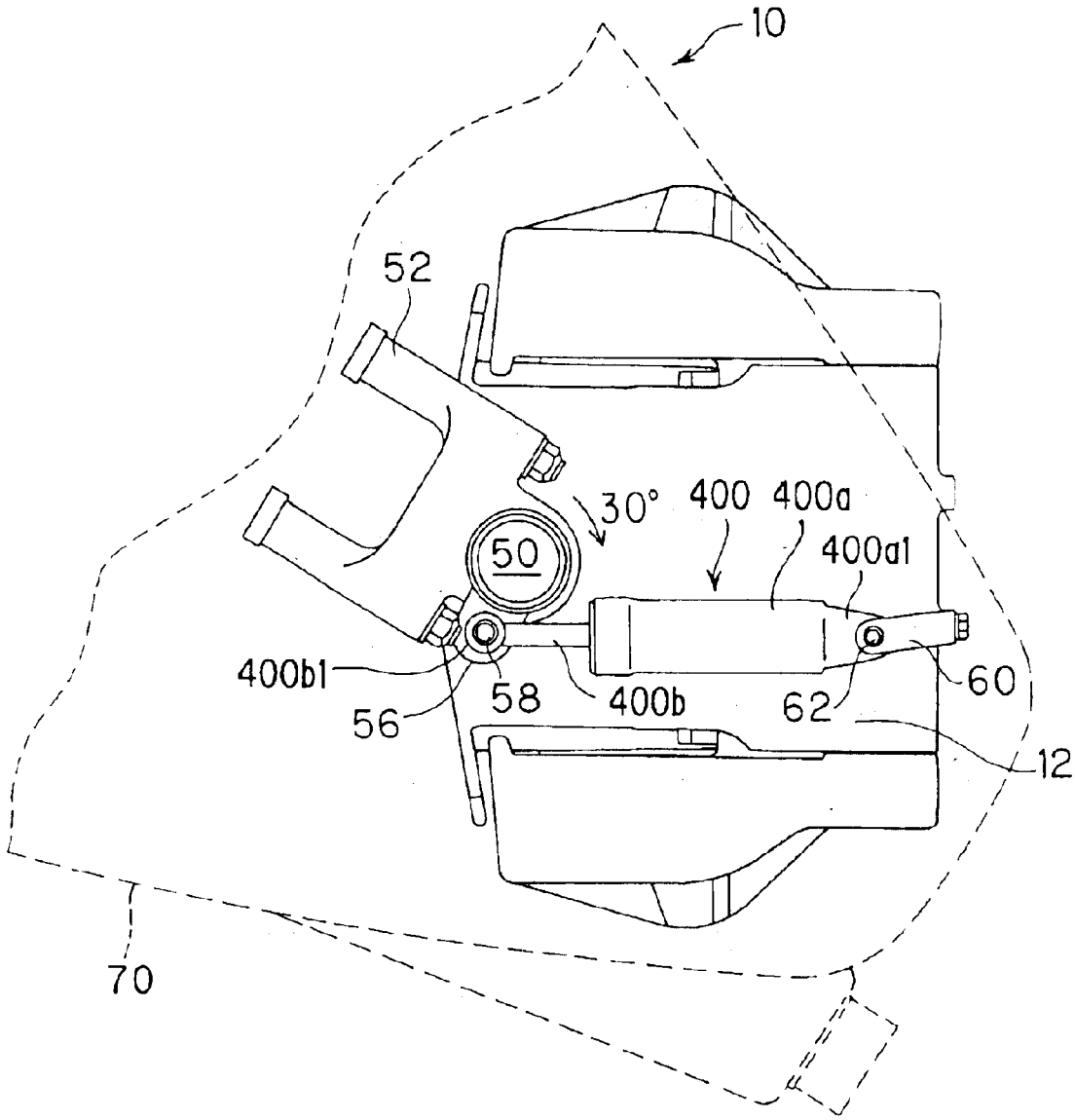
FIG. 11 is a view, similar to FIG. 5, but showing the positional relationship of the steering hydraulic cylinder, etc., relative to the profile of the outboard motor in the system according to the second embodiment when the outboard motor is steered (rotated) right at its maximum.
Figure 12:
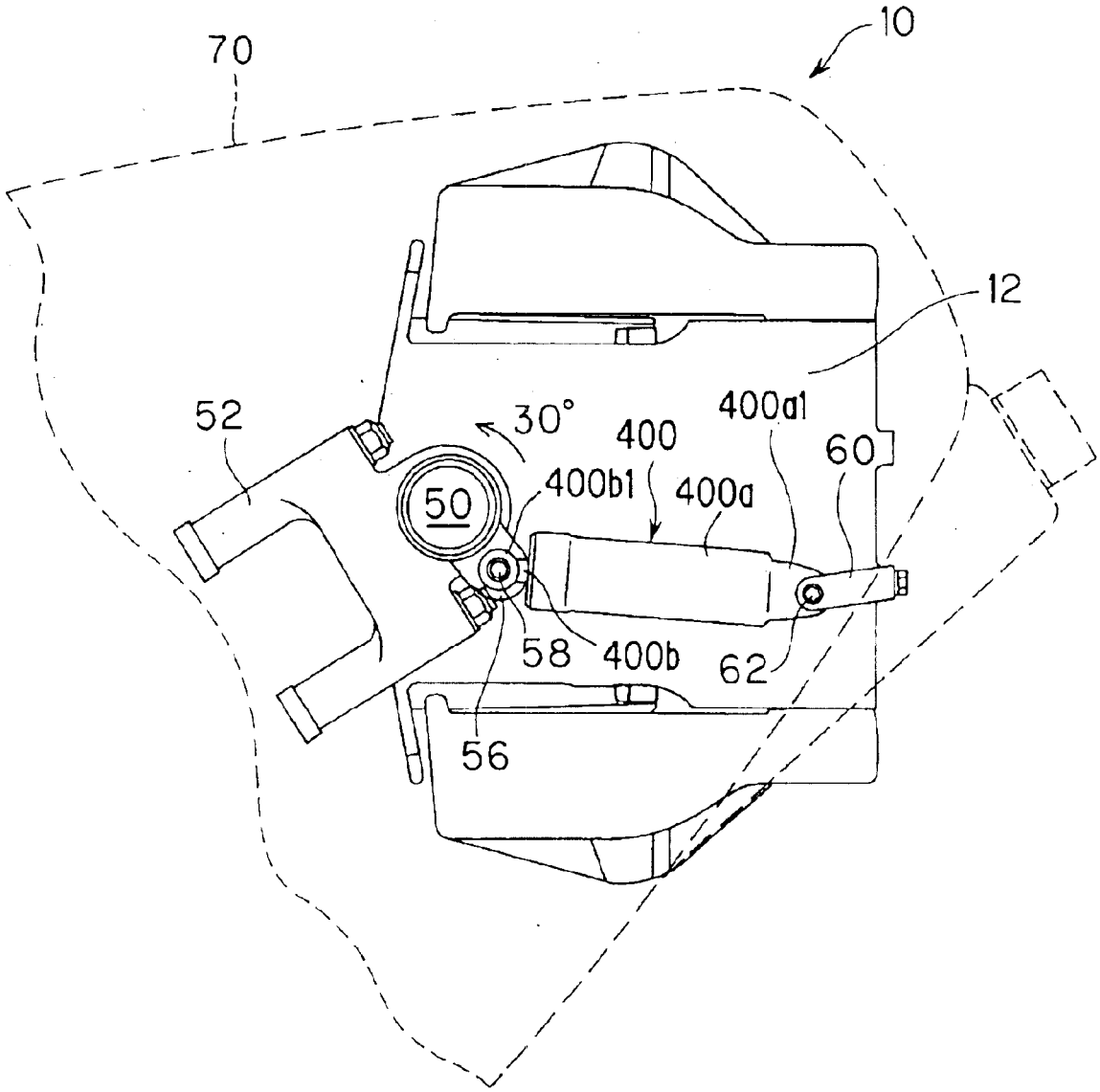
FIG. 12 is a view, similar to FIG. 6, but showing the positional relationship when the outboard motor is steered (rotated) left at its maximum.

FIG. 11 is a view, similar to FIG. 5, but showing the positional relationship of the elliptic cylinder 400, etc., relative to the profile 70 in the system according to the second embodiment when the outboard motor is steered (rotated) right at its maximum, and FIG. 12 is a view, similar to FIG. 6, but showing the positional relationship when the outboard motor 10 is steered (rotated) left at its maximum.

Thus, the hydraulic actuator 400 in the system according to the second embodiment is also arranged to have a shape whose height is larger than its width and being installed in such a manner that a direction of the height is in parallel with a vertical direction, such that the actuator does not project outside the profile 70 obtained by looking down the outboard motor from downward in the vertical direction, regardless of a steered angle of the outboard motor 10. Specifically, the actuator comprises the elliptic hydraulic cylinder 400 (400*a*) having a plurality of piston rods 400*b*1, 400*c*1 that are installed in an over-under manner such that the direction of the height is in parallel with the vertical direction.

Thus, since the outboard motor steering system according to the second embodiment is arranged such that the swivel shaft 50 (acting as the steering shaft of the motor 10) is rotated by the actuator, i.e., the elliptic cylinder 400 (comprised of the first and second piston rods 400*b*, 400*c*) to steer the motor 10, it can enhance the output of the actuator and hence, can increase the steering force (torque).

Further, since the first and second piston rods 400*b*, 400*c* are arranged such that they are overlapped in the over-under manner in the vertical axis and their longitudinal axes are in parallel with the horizontal axis, the elliptic cylinder 400 never project horizontally outside the profile 70 of the outboard motor 10, regardless of the steered angle of the outboard motor 10.

In addition, since the force generated by the elliptic cylinder 400 is transmitted to the swivel shaft 50 through the two piston rods 400*b*, 400*c*, the stress acting on the connecting parts (i.e., the first stay 56, the first cylindrical member 58, etc.) is distributed or divided, thereby enabling to improve the degree of freedom in designing the connecting parts or thereabout.

It should be noted in the second embodiment that, although the cylinder is the elliptic cylinder 400 having a shape of ellipse in cross section, this embodiment should not be limited thereto and any other shape of a cylinder having a non-circular cross section with a major axis and a minor axis may be used as the actuator.

It should further be noted in the second embodiment, although the number of piston rods is made two, this embodiment should not be limited thereto and the number of piston rods may be increased to three or more.

The first and second embodiments are thus arranged to have a steering system for an outboard motor 10 mounted on a stern of a boat 16 and having an internal combustion engine 18 at its upper portion and a propeller 24 with a rudder 26 at its lower portion powered by the engine to propel and steer the boat, comprising: a swivel shaft 50 connected to the propeller to turn the propeller relative to the boat; a swivel case 12 fixed to the outboard motor and rotatably accommodating the swivel shaft; and a hydraulic actuator (40, 400) connected to the swivel shaft to rotate the swivel shaft, the hydraulic actuator having a shape whose height is larger than its width and being installed in such a manner that a direction of the height is in parallel with a vertical direction, such that the actuator does not project outside a profile 70 of the outboard motor 10, obtained by looking down the outboard motor from downward in the vertical direction, regardless of a steered angle of the outboard motor.

In the system, a displaceable end (40*a*1, 40*b*1, 400*b*1, 400*c*1) of the actuator is connected to a mount frame 52 that is connected to the swivel shaft 50, whereas a fixed end (40*a*2, 40*b*2, 400*a*1) of the actuator is connected to the swivel case 12. The actuator comprises a plurality of (two) hydraulic cylinders 40*a*, 40*b*, whose displaceable ends (40*a*1, 40*b*1) are connected to the mount frame 52, whereas whose fixed ends (40*a*2, 40*b*2) are connected to the swivel case, and the cylinders 40*a*, 40*b* are installed in an over-under manner such that the direction of the height is in parallel with the vertical direction. Further, the cylinders 40*a*, 40*b* are installed in such a manner that whose longitudinal axis is in parallel with a horizontal direction that crosses the vertical direction with a right angle.

Further, the displaceable ends (40*a*1, 40*b*1) of the cylinders 40*a*, 40*b* are coaxially connected to a mount frame 52 that is connected to the swivel shaft 50, whereas fixed ends of the cylinders 40*a*, 40*b* are coaxially connected to the swivel case. The cylinders 40*a*, 40*b* are double-acting cylinders whose extraction/contraction are made equal to each other when supplied with hydraulic pressure in response to a command to steer the boat.

Alternatively, the actuator comprises a hydraulic cylinder 400 (400*a*) having a plurality of piston rods 400*b*, 400*c* whose displaceable ends (400*b*1, 400*c*1) are connected to the mount frame 52, whereas whose fixed ends (400*a*1) are connected to the swivel case. The actuator comprises an elliptic hydraulic cylinder 400 (400*a*) having a plurality of piston rods 400*b*1, 400*c*1 that are installed in an over-under manner such that the direction of the height is in parallel with the vertical direction. The piston rods 400*b*, 400*c* are installed in such a manner that whose longitudinal axis is in parallel with a horizontal direction that crosses the vertical direction with a right angle.

Further, the displaceable ends (400*b*1, 400*c*1) of the piston rods 400*b*, 400*c* are coaxially connected to a mount frame 52 that is connected to, the swivel shaft. The cylinder 400 (400*a*) is a double-acting cylinder and extraction/contraction of the piston rods are made equal to each other when supplied with hydraulic pressure in response to a command to steer the boat.

It should be noted in the above that, although the hydraulic cylinder is used as the actuator to rotate the swivel shaft 50, the invention should not be limited thereto and a hydraulic motor or some similar factors may be used as the actuator.

The entire disclosure of Japanese Patent Application Nos. 2003-010049 and 2003-010050, both filed on Jan. 17, 2003, including specification, claims, drawings and summary, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A steering system for an outboard motor mounted on a stem of a boat and having an internal combustion engine at its upper portion and a propeller with a rudder at its lower portion powered by the engine to propel and steer the boat, comprising:

a swivel shaft connected to the propeller to turn the propeller relative to the boat;

a swivel case fixed to the outboard motor and rotatably accommodating the swivel shaft; and a hydraulic actuator connected to the swivel shaft to rotate the swivel shaft, the hydraulic actuator having a shape whose height is larger than its width and being installed in such a manner that a direction of the height is in parallel with a vertical direction, such that the actuator does not project outside a profile of the outboard motor, obtained by looking down the outboard motor from downward in the vertical direction, regardless of a steered angle of the outboard motor.

2. A system according to claim 1, wherein a displaceable end of the actuator is connected to a mount frame that is connected to the swivel shaft, whereas a fixed end of the actuator is connected to the swivel case.

3. A system according to claim 1, wherein the actuator comprises a plurality of hydraulic cylinders whose displaceable ends are connected to a mount frame, whereas whose fixed ends are connected to the swivel case.

4. A system according to claim 1, wherein the actuator comprises a plurality of cylindrical hydraulic cylinders that are installed in an over-under manner such that the direction of the height is in parallel with the vertical direction.

5. A system according to claim 4, wherein the cylinders are installed in such a manner that whose longitudinal axis is in parallel with a horizontal direction that crosses the vertical direction with a right angle.

6. A system according to claim 4, wherein displaceable ends of the cylinders are coaxially connected to a mount frame that is connected to the swivel shaft, whereas fixed ends of the cylinders are coaxially connected to the swivel case.

7. A system according to claim 4, wherein the cylinders are double-acting cylinders whose extraction/contraction are made equal to each other when supplied with hydraulic pressure in response to a command to steer the boat.

8. A system according to claim 1, wherein the actuator comprises a hydraulic cylinder having a plurality of piston rods whose displaceable ends are connected to a mount frame, whereas whose fixed ends are connected to the swivel case.

9. A system according to claim 1, wherein the actuator comprises an elliptic hydraulic cylinder having a plurality of piston rods that are installed in an over-under manner such that the direction of the height is in parallel with the vertical direction.

10. A system according to claim 9, wherein the piston rods are installed in such a manner that whose longitudinal axis is in parallel with a horizontal direction that crosses the vertical direction with a right angle.

11. A system according to claim 9, wherein displaceable ends of the piston rods are coaxially connected to a mount frame that is connected to the swivel shaft.

12. A system according to claim 9, wherein the cylinder is a double-acting cylinder and extraction/contraction of the piston rods are made equal to each other when supplied with hydraulic pressure in response to a command to steer the boat.

* * * * *